US006118034A

United States Patent [19]

Vicari et al.

[11] Patent Number: 6,118,034

[45] Date of Patent: Sep. 12, 2000

[54] PROCESS FOR THE SELECTIVE HYDROGENATION OF DIENES IN REFORMATE FLOWS

[75] Inventors: Maximilian Vicari, Limburgerhof; Marc Walter, Frankenthal; Ekkehard Schwab, Neustadt; Hans-Joachim Müller, Grünstadt; Germain Kons, Mannheim; Stephan Dilling, Edingen-Neckarhausen; Peter Polanek, Weinheim, all of Germany

[73] Assignee: BASF Aktiengesellschaft, Ludwigshafen, Germany

[21] Appl. No.: 09/142,217

[22] PCT Filed: Feb. 27, 1997

[86] PCT No.: PCT/EP97/00960

§ 371 Date: Sep. 3, 1998

§ 102(e) Date: Sep. 3, 1998

[87] PCT Pub. No.: WO97/32944

PCT Pub. Date: Sep. 12, 1997

[30] Foreign Application Priority Data

Mar. 4, 1996 [DE] Germany ..... 196 08 241

[51] Int. Cl.[7] ..... C07C 5/03

[52] U.S. Cl. ..... 585/262; 585/259; 585/261; 585/263; 585/264; 585/274; 585/276

[58] Field of Search ..... 585/259, 261, 585/263, 264, 274, 276

[56] References Cited

U.S. PATENT DOCUMENTS

| | | | |
|---|---|---|---|
| 2,906,790 | 2/1959 | Smyth | 260/677 |
| 4,659,687 | 4/1987 | Cymbaluk | 502/207 |
| 5,417,844 | 5/1995 | Boitiaux et al. | 208/143 |
| 5,736,484 | 4/1998 | Polanek et al. | 502/349 |

FOREIGN PATENT DOCUMENTS

| | | |
|---|---|---|
| 466567 | 1/1992 | European Pat. Off. . |
| 672452 | 9/1995 | European Pat. Off. . |
| 685552 | 12/1995 | European Pat. Off. . |
| 2 131 043 | 6/1984 | United Kingdom . |

OTHER PUBLICATIONS

*Ullmann's Enc. of Ind. Chem.*, vol. A3, 5th Edition, p. 490, 1985.

*Primary Examiner*—Bekir L. Yildirim
*Attorney, Agent, or Firm*—Keil & Weinkauf

[57] ABSTRACT

In the process for the selective hydrogenation of dienes in diene-containing feed streams, a diene-containing feed stream is hydrogenated over a nickel-containing precipitated catalyst at from 40 to 100° C., a pressure of from 3 to 20 bar and a WHSV (weight hourly space velocity) of from 1 to 10 kg/(l×h) in the presence of free hydrogen.

6 Claims, No Drawings

PROCESS FOR THE SELECTIVE HYDROGENATION OF DIENES IN REFORMATE FLOWS

The present invention relates to a process for the selective hydrogenation of dienes, in particular of dienes in reformate streams (feed streams) over a nickel-containing precipitated catalyst. In addition, the present invention relates to a process for preparing high-purity aromatics or aromatic mixtures.

The reformate produced by catalytic reforming of naphtha represents a very important source of aromatics for isolating pure aromatics. Important constituents of the reformate stream are aromatic compounds such as benzine, toluene, xylene and ethylbenzene. The boiling range of the hydrocarbon mixture is between 60 and 180° C. Apart from the saturated hydrocarbons and aromatic compounds, the untreated reformate streams contain other constituents such as olefins and diolefms. To further process them to give pure aromatics, up to now a series of distillation, extraction and extractive distillation steps were used.

If high purities are required, the diene compounds which are difficult to separate off by means of the abovementioned physical processes have to be removed from the pure aromatic fraction. According to Ullmann's Encyclopedia of Industrial Chemistry, 5th Edition, Vol. A3, Page 490, Verlag Chemie, this is carried out by further treating the pure aromatics over an active alumina: on passing through the fixed bed, the diene compounds are selectively adsorbed. Disadvantages of this process are the high solids consumption and the necessity of disposing of the alumina contaminated with hydrocarbon compounds, disadvantages which are becoming increasingly important in line with ever stricter environmental controls.

An alternative process comprises the selective hydrogenation of traces of unsaturated compounds. FR-A 2 720 754 discloses, in the case of pyrolysis gasoline, selectively hydrogenating dienes over an impregnated palladium catalyst at about 150° C. and about 15 bar.

It is an object of the present invention to provide a process for the selective hydrogenation of dienes in which

- a highly effective hydrogenation of the dienes occurs
- aromatics are essentially not hydrogenated
- a stable, inexpensive catalyst is used
- the process can be automatically controlled simply and effectively, and
- the process can be conducted in a simple manner in existing plants and refineries.

We have found that this object is achieved by a process for the selective hydrogenation of dienes in diene-containing feed streams, which comprises hydrogenating such a diene-containing feed stream over a nickel-containing precipitated catalyst at from 40 to 100° C., a pressure of from 3 to 20 bar and a WHSV of from 1 to 10 kg/(l×h) in the presence of free hydrogen.

According to the present invention it has been found that nickel-containing precipitated catalysts which are known per se from EP-A 0 672 452 allow very effective selective hydrogenation of dienes, with the hydrogenation using this catalyst being carried out with high reformate space velocities over the catalyst and under low-pressure and low-temperature conditions. Using the process of the present invention, it is possible, during operation under low pressure and temperature conditions and a high reformate throughput, to feed the hydrogen into the hydrogenation reactor in such a way that the amount fed in is regulated as a function of the dienes being hydrogenated.

Precipitated Nickel Catalyst

The precipitated nickel catalysts used according to the present invention are described in EP-A 0 672 452. These catalysts consist essentially of from 65 to 80% of nickel calculated as nickel oxide, from 10 to 25% of silicon, calculated as silicon dioxide, from 2 to 10% of zirconium, calculated as zirconium oxide and from 0 to 10% of aluminum, calculated as aluminum oxide, with the proviso that the sum of the contents of silicon dioxide and aluminum oxide is at least 15% (percentages in percent by weight, based on the total mass of the catalyst). They are prepared by addition of an acid aqueous solution of nickel, zirconium, and, if desired, aluminum salts to a basic aqueous solution of silicon and, if desired, aluminum compounds, with the pH being lowered to at least 6.5 and subsequently being adjusted to from 7 to 8 by an addition of further basic solution, isolating the solid thus precipitated, drying, shaping and calcining.

The catalysts used according to the present invention preferably comprise from 70 to 78% of nickel, from 10 to 20% of silicon, from 3 to 7% of zirconium, and from 2 to 10% of aluminum.

Preference is given to using catalysts which comprise only nickel as catalytically active metal. In particular, catalysts which are free of palladium can be used.

In addition to the oxides specified, the catalysts can contain promoters in amounts of up to 10%. These are compounds such as CuO, $TiO_2$, MgO, CaO, ZnO, and $B_2O_3$. However, preference is given to catalysts which contain no promoters.

The catalysts applied in the present invention are prepared starting from aqueous acid solutions of nickel, zirconium, and, if desired, aluminum salts. Suitable salts are organic and inorganic salts such as acetates, sulfates, carbonates, but preferably nitrates of the metals specified. The total content of metal salts is generally from 30 to 40% by weight. Since the later precipitation of the metals from the solution is virtually quantitative, the concentration of the individual components in the solution depends only on the content of this component in the catalyst to be prepared. The aqueous solution is adjusted to a pH of below 2 by addition of a mineral acid, preferably nitric acid.

This solution is, advantageously whilst stirring, introduced into an aqueous basic solution comprising silicon compounds and, if desired, aluminum compounds. This solution comprises, for example, alkali metal hydroxide or preferably sodium carbonate, generally in amounts of from 15 to 40% by weight, based on the solution. The pH is generally above 10.

Suitable silicon compounds are water glass, which is preferred, and also $SiO_2$. The silicon content of the solution is advantageously from 0.5 to 4% by weight. In addition, the solution can, if desired, contain aluminum compounds in the form of oxidic solids, although it is preferred to add aluminum salts only to the acid solution. The addition of the acid solution to the basic solution is generally carried out at from 30 to 100° C., preferably at from 60 to 80° C. It is generally carried out over a period of from 0.5 to 4 hours.

A sufficient amount of the acid solution is added for the pH to drop to at least 6.5, thus precipitating insoluble compounds. Preference is given to a range from 4.0 to 6.5, particularly preferably from 5.5 to 6.5. Lower pH values are possible, but give no discernible advantage for the catalysts thus prepared. In general, this pH is maintained for from 1 to 60 minutes, depending on the amount of the solutions used, then adjusted to from 7 to 8 by addition of further basic solution and the precipitation of the metal compounds is completed at this pH.

If catalysts containing promoters are desired, it is advantageous to add soluble metal salts as precursors for the promoters to one of the solutions described, to coprecipitate these metals and to further process the precipitation product thus obtained. However, the promoters can also be added as solids to the precipitation solution.

The precipitated product is isolated, for example, by filtration. In general, this is followed by a washing step during which, in particular, any alkali metal ions and nitrate ions entrained during the precipitation are washed out. Subsequently, the solid thus obtained is dried, for which purpose a drying oven or a spray dryer can be used for example, depending on the amount of material to be dried. In general, the drying temperature is from 100 to 200° C. If desired, the above- mentioned promoters can be mixed into the solid prior to the next process step. The dried product is then preferably calcined, generally at from 300 to 700° C., preferably from 320 to 450° C., over a period of from 0.5 to 8 hours.

For use according to the present invention, the calcined solid is shaped to produce shaped bodies, for example by extrusion to give extrudates or by tableting. For this purpose, peptizing agents such as nitric acid or formic acid are added to the calcined solid in amounts generally from 0.1 to 10% by weight, based on the solid to be shaped. For tableting, graphite can, for example, be used. The shaped bodies thus obtained are generally calcined at from 300 to 700° C., preferably from 350 to 500° C., for from 1 to 8 hours.

Hydrogenation Process

The process parameters used according to the present invention and the preferred process parameters are shown in the table below.

Hydrogenation Process Parameters

| | Range | Preferred range |
|---|---|---|
| Temperature | 40–100 ° | 50–80° C. |
| Pressure | 3–20 bar | 5–12 bar |
| WHSV* | 1–10 kg/(l × h) | 3–7 kg/(l × h) |

*Weight hourly space velocity

Feed Streams

The feed streams preferably used in the process of the present invention comprise from about 15 to about 90% by weight of aromatics and up to about 5000 ppm by weight of dienes. The most preferred feed streams are reformate streams.

In a particularly preferred embodiment of the process according to the present invention, the hydrogen is fed into the hydrogenation step in a regulated manner so that the amount of hydrogen fed in is approximately that required for hydrogenating the dienes. The regulation is here preferably carried out such that from 1 to 1.3 mol, preferably from 1 to 1.2 mol, particularly about 1.2 mol of hydrogen is fed in per mol of diene structure in the feed stream.

Preference is given to carrying out the process using a catalyst comprising from 65 to 80% by weight of nickel, from 10 to 25% by weight of silicon, from 2 to 10% by weight of zirconium, from 0 to 10% by weight of aluminum, all components calculated as oxides and percentages by weight based on the total mass of the catalyst, with the proviso that the sum of the contents of silicon dioxide and aluminum oxide is at least 15%.

Furthermore, it is preferred according to the present invention for hydrogenated product to be separated in an extractive distillation step into an aromatic hydrocarbon mixture and a non-aromatic hydrocarbon mixture.

Finally, it is provided for and preferred according to the present invention for the aromatic content of the mixture to be hydrogenated to be increased prior to the selective hydrogenation by means of one or more upstream distillation, extraction and/or extracted distillation steps.

Surprisingly, the nickel-containing precipitated catalysts described also display a high selectivity in the hydrogenation of dienes in aromatic-rich hydrocarbon mixtures when the process is configured such that the catalyst is subjected to a high feed stream, especially reformate stream throughput at low pressure and temperature and the hydrogen is fed into the reactor in such a way that its amount is regulated as a function of the diene to be hydrogenated.

The use of the hydrogenation step according to the present invention is particularly useful in combination with a downstream extractive distillation of the hydrogenated product to isolate the valuable aromatics. It is already known that aromatic hydrocarbon mixtures can be obtained selectively from aromatic/non-aromatic hydrocarbon mixtures by extractive distillation, with the organic solvent used comprising a high-boiling polar liquid (Ullman's Encyclopedia of Industrial Chemistry, 5th edition, vol. A3, page 490, Verlag Chemie). DE-A 20 40 025 discloses the fact that N-substituted morpholines are particularly suitable as such a selective solvent. The preferred solvent for the extractive distillation step is NFM (N-formylmorpholine).

Accordingly, the compounds formed in the selective hydrogenation of the reformate stream can be very simply separated from the aromatic hydrocarbon mixture during the extractive distillation step. If the hydrogenation conditions are too drastic (e.g. end-of-run conditions) or the catalyst is too active, it is possible for aromatics to be hydrogenated. The naphthenes thus formed are likewise removed from the aromatic mixture during the extractive distillation step, so that high purity is ensured without additional treatment with alumina.

The practical utility of the process of the present invention is demonstrated by the example below. The starting hydrocarbon mixture used was a benzene-rich reformate fraction. The purity in respect of diene compounds present was tested by means of the wash color test in accordance with ASTM D-848. The experimental reactor was operated in a downflow mode under the following conditions:

temperature: T=60° C.

pressure: $PH_2$=10 bar throughput: WHSV=6 kg/($l_{Cat}$×h)

off-gas: 1.7 standard l/kg

| | Feed | Precipitated Ni catalyst* (according to the present invention) | Impregnated Pd catalyst (according to FR 2 720 754) |
|---|---|---|---|
| Wash color test (in accordance with | 6 | 1 | 3 |

-continued

| | Feed | Precipitated Ni catalyst* (according to the present invention) | Impregnated Pd catalyst (according to FR 2 720 754) |
|---|---|---|---|
| ASTM D-848) Loss of aromatics | — | <0.1% by weight | <0.1% by weight |

*as described in EP-A 0 672 452 with the following composition
N 75% by weight
Si 15% by weight
Al 5% by weight
Zr 5% by weight
(all as oxides)

This example shows that the diene compounds present in the reformate are selectively hydrogenated by use of the nickel-containing precipitated catalyst according to the present invention, which leads e.g. to the wash color test value being improved without a high loss of aromatics.

We claim:

1. A process for the selective hydrogenation of dienes in diene-containing feed streams, which comprises hydrogenating such a diene-containing feed stream over a nickel-containing precipitated catalyst at from 40 to 100° C., a pressure of from 3 to 20 bar and a WHSV of from 1 to 10 kg/(l×h) in the presence of free hydrogen, wherein the catalyst comprises from 65 to 80% of nickel, from 10 to 25% of silicon, from 2 to 10% of zirconium, from 0 to 10% of aluminum, all components calculated as oxides and percentages by weight based on the total mass of the catalyst, with the proviso that the sum of the content of silicon dioxide and aluminum oxide is at least 15%.

2. A process as claimed in claim 1, being conducted at from 50 to 80° C., a pressure of from 5 to 12 bar and a WHSV of from 3 to 7 kg/(l×h).

3. A process as claimed in claim 1, wherein the feed stream comprises from 15 to 90% by weight of aromatics and up to 5000 ppm by weight of dienes.

4. A process as claimed in claim 1, wherein the hydrogen is fed into the hydrogenation step in such a way that its amount is regulated as a function of the dienes to be hydrogenated, being from 1 to 1.3 mol of hydrogen per mol of diene structure in the feed stream.

5. A process as claimed in claim 1, wherein hydrogenated product is separated in an extractive distillation step into an aromatic hydrocarbon mixture and a non-aromatic hydrocarbon mixture.

6. A process as claimed in claim 1, wherein the aromatic content of the feed stream is increased prior to the selective hydrogenation by means of one or more upstream distillation, extraction and/or extractive distillation steps.

* * * * *